US007703867B2

(12) United States Patent
Katsumura

(10) Patent No.: US 7,703,867 B2
(45) Date of Patent: Apr. 27, 2010

(54) LIQUID CONTAINER WITH LIQUID DETECTING UNIT

(75) Inventor: Takayoshi Katsumura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 659 days.

(21) Appl. No.: 11/565,085

(22) Filed: Nov. 30, 2006

(65) Prior Publication Data

US 2007/0120882 A1 May 31, 2007

(30) Foreign Application Priority Data

Nov. 30, 2005 (JP) ..... 2005-347092
Aug. 12, 2006 (JP) ..... 2006-220760

(51) Int. Cl.
*B41J 2/195* (2006.01)
*B41J 2/17* (2006.01)
*B41J 2/175* (2006.01)

(52) U.S. Cl. ..... 347/7; 347/84; 347/85

(58) Field of Classification Search ..... 347/7, 347/6, 84, 85, 86, 87, 19
See application file for complete search history.

(56) References Cited

U.S. PATENT DOCUMENTS 6,802,602 B2 * 10/2004 Sakai et al. ..... 347/86
7,281,776 B2 * 10/2007 Usui et al. ..... 347/7
7,461,909 B2 * 12/2008 Zhang et al. ..... 347/7
7,510,251 B2 * 3/2009 Wanibe et al. ..... 347/7
2003/0117450 A1 6/2003 Usui et al.
2005/0243110 A1 * 11/2005 Takahashi et al. ..... 347/7

FOREIGN PATENT DOCUMENTS

EP 1 053 881 A1 11/2000
EP 1 314 565 A2 5/2003
JP 2001-146019 A 5/2001

OTHER PUBLICATIONS

Partial European Search Report from European patent appln. No. 06125158.3 (May 8, 2008).
Extended European Search Report for European patent application No. 06125158.3 (Aug. 11, 2008).

* cited by examiner

*Primary Examiner*—Stephen D Meier
*Assistant Examiner*—Rene Garcia, Jr.
(74) *Attorney, Agent, or Firm*—Stroock & Stroock & Lavan LLP

(57) ABSTRACT

A liquid container detachably mounted on a liquid consuming device, the liquid container includes: a liquid containing portion; a liquid supply portion that is connected to the liquid consuming device; a liquid guide path that guides a liquid stored in the liquid containing portion to the liquid supply portion; an air communicating opening that introduces air from the outside into the liquid containing portion according to consumption of the liquid in the liquid containing portion; and a liquid detecting unit that is provided in the middle of the liquid guide path and detects an inflow of the air into the liquid guide path so as to detect that the liquid of the liquid containing portion is exhausted to a predetermined amount, wherein, a dam portion is provided in the liquid guide path such that its upper end is disposed above in a vertical direction a circumferential upper portion of a liquid inflow opening causing the liquid to flow into the liquid detecting unit.

12 Claims, 6 Drawing Sheets

LIQUID CONTAINER WITH LIQUID DETECTING UNIT

BACKGROUND

1. Technical Field

The present invention relates to a liquid container of an air-open type that is suitable for an ink cartridge to be detachably mounted on an ink jet printer. In particular, the present invention relates to a technique that, in a liquid container having a liquid detecting unit for detecting a consumption state of a liquid in a liquid containing portion, can detect a change in acoustic impedance so as to prevent erroneous detection due to sticking of bubbles to the liquid detecting unit.

2. Related Art

As an ink cartridge (liquid container) to be detachably mounted on an ink jet printer, various kinds of air-open type ink cartridges are suggested. The air-open type ink cartridge has, in a container main body that is detachably mounted on a printer, an ink containing portion (liquid containing portion) that contains ink, an ink supply portion (liquid supply portion) that is connected to a printing head (liquid jetting unit) of the printer, an ink guide path (liquid guide path) that guides ink stored in the ink containing portion to the ink supply portion, and an air communicating opening that introduces air from the outside into the ink containing portion according to consumption of the ink in the ink containing portion.

In such an ink cartridge, an ink residual quantity detecting mechanism (liquid detecting unit), in which a sensor having a piezoelectric vibrating body is disposed at a reference height in the liquid containing portion, is provided (for example, see Patent Document 1). In the ink residual quantity detecting mechanism (liquid detecting unit), if the liquid level of ink of the liquid containing portion falls to the reference height due to ink consumption by printing, and fresh air introduced from the air communicating opening into the liquid containing portion according to ink consumption reaches a detection position of the sensor. Then, it is detected, from a change in vibration characteristic (residual vibration) between when the periphery of the sensor is filled with the ink liquid and when air is in contact with the periphery of the sensor, that the liquid level of ink falls to the reference height.

That is, a change of acoustic impedance is detected by causing a piezoelectric device having a piezoelectric element or a vibrating portion of an actuator vibrate, subsequently measuring a counter electromotive force generated by the residual vibration remaining in the vibrating portion, and detecting an amplitude of a resonance frequency or a counter electromotive force waveform. The detection signal is used to display the residual quantity of ink or give notice of a cartridge replacement time.

Patent Document 1: JP-A-2001-146019

However, in the air-open type ink cartridge, air in the liquid containing portion may become bubbles by mixed in the ink due to a vibration at the transportation time after manufactured or fresh air introduced from the air communicating opening into the liquid containing portion according to ink consumption may become minute bubbles due to an impact upon attachment/detachment of the cartridge, and the bubbles may float in the ink liquid. Then, if the bubbles floating in the ink liquid are stuck to the surface of the sensor of the ink residual quantity detecting mechanism, the stuck bubbles may cause a change in residual vibration. Accordingly, presence/absence of ink may be not accurately detected, and it may be erroneously detected that the liquid level of ink falls.

That is, a known air-open type ink cartridge uses a vibration phenomenon, and thus the state of the liquid in the liquid container (including presence/absence of the liquid in the liquid container, the quantity of the liquid, the liquid level of the liquid, the kind of the liquid, the composition of the liquid) can be detected. However, any countermeasure against the erroneous detection due to sticking of the bubbles to the surface of the sensor has not been suggested yet. As a result, the erroneous detection of the ink residual quantity due to sticking of the bubbles to the surface of the sensor may occur.

SUMMARY

An advantage of some aspects of the invention is to provide a liquid container that can prevent erroneous detection of a liquid residual quantity due to an inflow of bubbles into a liquid detecting unit of a liquid guide path. The advantage can be attained as at least one of the following aspects:

A first aspect of the invention is to provide a liquid container detachably mounted on a liquid consuming device, the liquid container comprising: a liquid containing portion; a liquid supply portion that is connected to the liquid consuming device; a liquid guide path that guides a liquid stored in the liquid containing portion to the liquid supply portion; an air communicating opening that introduces air from the outside into the liquid containing portion according to consumption of the liquid in the liquid containing portion; and a liquid detecting unit that is provided in the middle of the liquid guide path and detects an inflow of the air into the liquid guide path so as to detect that the liquid of the liquid containing portion is exhausted to a predetermined amount, wherein, a dam portion is provided in the liquid guide path such that its upper end is disposed above in a vertical direction a circumferential upper portion of a liquid inflow opening causing the liquid to flow into the liquid detecting unit.

According to the liquid container having the above-described configuration, the liquid passing through the liquid guide path passes through the dam portion, and then flows into the liquid inflow opening located at a position lower than the upper end of the dam portion. At this time, when bubbles are mixed in the liquid passing through the dam portion, buoyancy acts on the bubbles upon approach to the liquid inflow opening.

Accordingly, the bubbles rarely enter the liquid inflow opening. Further, when the liquid of the liquid guide path gradually decreases, a liquid level gradually falls from an upper end. Therefore, when a residual liquid exists in the liquid guide path, there is no case where the liquid level reaches the liquid inflow opening earlier.

A second aspect of the invention provides a liquid container detachably mounted on a liquid consuming device, the liquid container comprising: a liquid containing portion; a liquid supply portion that is connected to the liquid consuming device; a liquid guide path that guides a liquid stored in the liquid containing portion to the liquid supply portion; an air communicating opening that introduces air from the outside into the liquid containing portion according to consumption of the liquid in the liquid containing portion; and a liquid detecting unit that is provided in the middle of the liquid guide path and detects an inflow of air into the liquid guide path so as to detect that the liquid of the liquid containing portion is exhausted to a predetermined amount, wherein, a dam portion is provided in the liquid guide path such that its upper end is disposed above in a vertical direction a circumferential upper portion of a liquid inflow opening causing the liquid to flow into the liquid detecting unit, and wherein the liquid is filled in the liquid guide path by such an amount that bubbles passing through the dam portion can be stored above the upper end of the dam portion.

According to the liquid container having the above-described configuration, the liquid passing through the liquid guide path passes through the dam portion, and then flows into the liquid inflow opening located at a position lower than the upper end of the dam portion. At this time, when bubbles are mixed in the liquid passing through the dam portion, buoyancy acts on the bubbles upon approach to the liquid inflow opening by the liquid filled in the liquid guide path.

Accordingly, the bubbles rarely enter the liquid inflow opening. Further, when the liquid of the liquid guide path gradually decreases, a liquid level gradually falls from an upper end. Therefore, when a residual liquid exists in the liquid guide path, there is no case where the liquid level reaches the liquid inflow opening earlier.

In the liquid container having the above-described configuration, at least a part of a bottom surface of the liquid guide path between the liquid inflow opening and the dam portion may be inclined vertically downward toward the liquid inflow opening.

According to this configuration, when the liquid of the liquid guide path gradually decreases and the liquid level gradually falls from the upper end of the dam portion, the liquid distant from the liquid inflow opening gradually flows along the inclined bottom surface toward the liquid inflow opening.

That is, the discharge of the liquid becomes good, and the entire residual liquid is guided to the liquid inflow opening without remaining in the liquid guide path.

In the liquid container having the above-described configuration, a narrow flow passage may be formed in the liquid guide path so as to cause a capillary phenomenon in the liquid.

According to this configuration, if the liquid of the liquid guide path enters the narrow flow passage, the liquid is sucked into the liquid inflow opening by the liquid flow and the capillary phenomenon, and thus a good liquid flow with no delay is obtained. Further, when the termination of the liquid of the liquid guide path (a boundary between air and liquid) passes through the narrow flow passage, the liquid at the termination is guided to the liquid inflow opening by a suction action according to the capillary phenomenon, without remaining at the termination.

In the liquid container having the above-described configuration, a plurality of narrow flow passages may be formed in parallel.

According to this configuration, the suction action by the capillary phenomenon of the individual narrow flow passages is secured, and a large sectional area of a flow passage, through which the liquid passes, is secured, thereby reducing a head loss of the liquid. Further, it is possible to reduce a possibility that a large bubble (or a boundary between air and liquid) reaches the liquid inflow opening compared with a case where one liquid guide path having the same flow passage sectional area is formed.

In the liquid container having the above-described configuration, the narrow flow passage may be formed in a rectangular sectional shape.

According to this configuration, since a short side of the rectangular sectional shape is set sufficiently smaller than its long side, the flow passage becomes flat. Further, it is possible to enhance a bubble inflow prevention effect compared with a case the liquid guide path having the same flow passage sectional area is formed in a circular shape.

In the liquid container having the above-described configuration, an inlet port on an uppermost stream side of the liquid guide path may be a round hole having a diameter larger than a short side of the rectangular sectional shape of the narrow flow passage.

According to this configuration, the inlet port of the liquid guide path is the round hole having a diameter larger than the short side of the rectangular sectional shape of the narrow flow passage. Accordingly, when bubbles having a diameter equal to or less than the short side of the rectangular sectional shape flow into the inlet port, the bubbles can be combined with each other and grown to have the same size as the round hole to the maximum, such that the bubbles rarely pass through the narrow flow passage. That is, when the inlet port is formed to have a diameter equal to or less than the short side of the rectangular sectional shape, all the bubbles passing through the inlet port enter the narrow flow passage. According to the above-described configuration, however, since the bubbles are grown to have a size not enough to pass through the narrow flow passage, the bubbles can be effectively prevented from entering the liquid inflow opening.

In the liquid container having the above-described configuration, at least one of inner wall surfaces in the narrow flow passage may serve as an inner wall surface of the liquid guide path.

According to this configuration, since the inner wall surface of the narrow flow passage becomes the inner wall surface of the liquid guide path, a bubble, an outer circumference of which is brought into contact with the inner wall surface of the liquid guide path and which has a diameter not enough to enter the narrow flow passage, becomes eccentric to the narrow flow passage.

That is, since the bubble is bound by the inner wall surface, the bubble is forcibly deformed asymmetrically to a symmetry axis passing through the center. In this case, with the action of surface tension, the asymmetric deformation exhibits a larger restitution force of the bubble to a sphere than the symmetric deformation does. Accordingly, the bubbles can rarely be sucked into the narrow flow passage. That is, the liquid can easily enter the narrow flow passage.

Since the inner wall surface of the narrow flow passage becomes the inner wall surface of the liquid guide path, a corner that is formed between the inner wall surfaces extends to the liquid guide path and the liquid inflow opening. Accordingly, the liquid in the narrow flow passage can be attracted to the liquid inflow opening by the capillary phenomenon occurring at the corner.

In the liquid container having the above-described configuration, in the liquid guide path, a step portion is provided such that its top surface on a downstream side is provided vertically downward from an upstream side.

According to this configuration, when the liquid flows in the liquid guide path toward the liquid inflow opening, the liquid is caught at the step portion. Thus when bubbles are mixed in the liquid, the bubbles are separated from the liquid, and the separated bubbles remain at the top surface above the step portion by buoyancy.

With this separation action, small bubbles that originally pass through the narrow flow passage can be grown to large bubbles that do not pass through the narrow flow passage, and thus bubbles are rarely stuck to the liquid detecting unit.

A third aspect of the invention provides a liquid container detachably mounted on a liquid consuming device, the liquid container comprising: a liquid containing portion; a liquid supply portion that is connected to the liquid consuming device; a liquid guide path that guides a liquid stored in the liquid containing portion to the liquid supply portion; an air communicating opening that introduces air from the outside into the liquid containing portion according to consumption of the liquid in the liquid containing portion; and a liquid detecting unit that is provided in the middle of the liquid guide path and detects an inflow of air into the liquid guide path so as to detect that the liquid of the liquid containing portion is exhausted to a predetermined amount, wherein a narrow flow passage is formed in a part of the liquid guide path communicating the liquid containing portion and the liquid detecting unit with each other so as to cause a capillary phenomenon in the liquid, and wherein a step portion is provided at a upstream of the narrow flow passage such that its top surface on a downstream side is provided vertically downward from an upstream side.

According to this configuration, when the liquid flows in the liquid guide path toward the liquid inflow opening, the bubbles are separated from the liquid, and the separated bubbles remain at the top surface above the step portion by buoyancy.

With this separation action, small bubbles that originally pass through the narrow flow passage can be grown to large bubbles that do not pass through the narrow flow passage, and thus bubbles are rarely stuck to the liquid detecting unit.

In the liquid container having the above-described configuration, a plurality of the narrow flow passages may be formed in parallel.

In the liquid container having the above-described configuration, the narrow flow passage may be formed in a rectangular sectional shape.

In the liquid container having the above-described configuration, an inlet port on an uppermost stream side of the liquid guide path may be a round hole having a diameter larger than a short side of the rectangular sectional shape of the narrow flow passage.

In the liquid container having the above-described configuration, at least one of inner wall surfaces in the narrow flow passage may serve as an inner wall surface of the liquid guide path.

In the liquid containers according to the first and second aspects of the invention, the dam portion is provided above the circumferential upper portion of the liquid inflow opening in the vertical direction. Accordingly, the liquid that passes through the liquid guide passes through the dam portion and then flows into the liquid inflow opening located at the position lower than the upper end of the dam portion. Therefore, the bubbles are not mixed in the liquid passing through the dam portion, and the bubbles rarely enter the liquid inflow opening due to buoyancy against the approach of the bubbles to the liquid inflow opening by the liquid filled in the liquid guide path.

Accordingly, erroneous detection due to sticking of the bubbles mixed in the liquid of the liquid containing portion to the liquid detecting unit can be prevented. Further, when the liquid of the liquid guide path gradually decreases, the liquid level gradually falls from the upper end of the dam portion. Therefore, when the residual liquid exists in the liquid guide path, there is no case where the liquid level reaches the liquid inflow opening earlier. As a result, there is no case where the residual quantity of the liquid of the liquid containing portion is erroneously detected as zero, unlike the actual state.

The present disclosure relates to the subject matter contained in Japanese patent application Nos. 2005-347092 filed on Nov. 30, 2005 and 2006-220760 filed on Aug. 12, 2006, which are expressly incorporated herein by reference in its entirety.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid container according to an embodiment of the invention will be described in detail with reference to the accompanying drawings.

Figure 1:
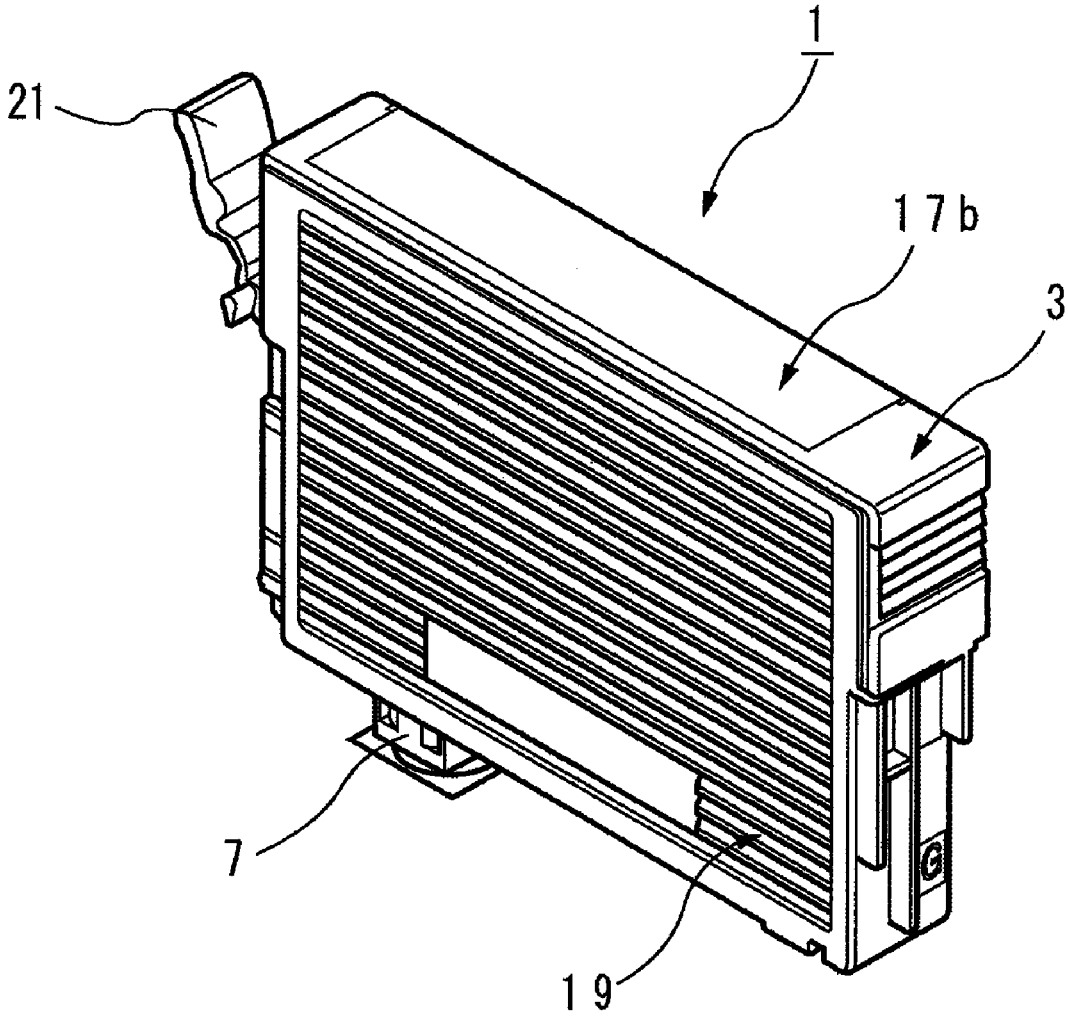
FIG. 1 is an exterior perspective view of a liquid container according to an embodiment of the invention.
Figure 2:
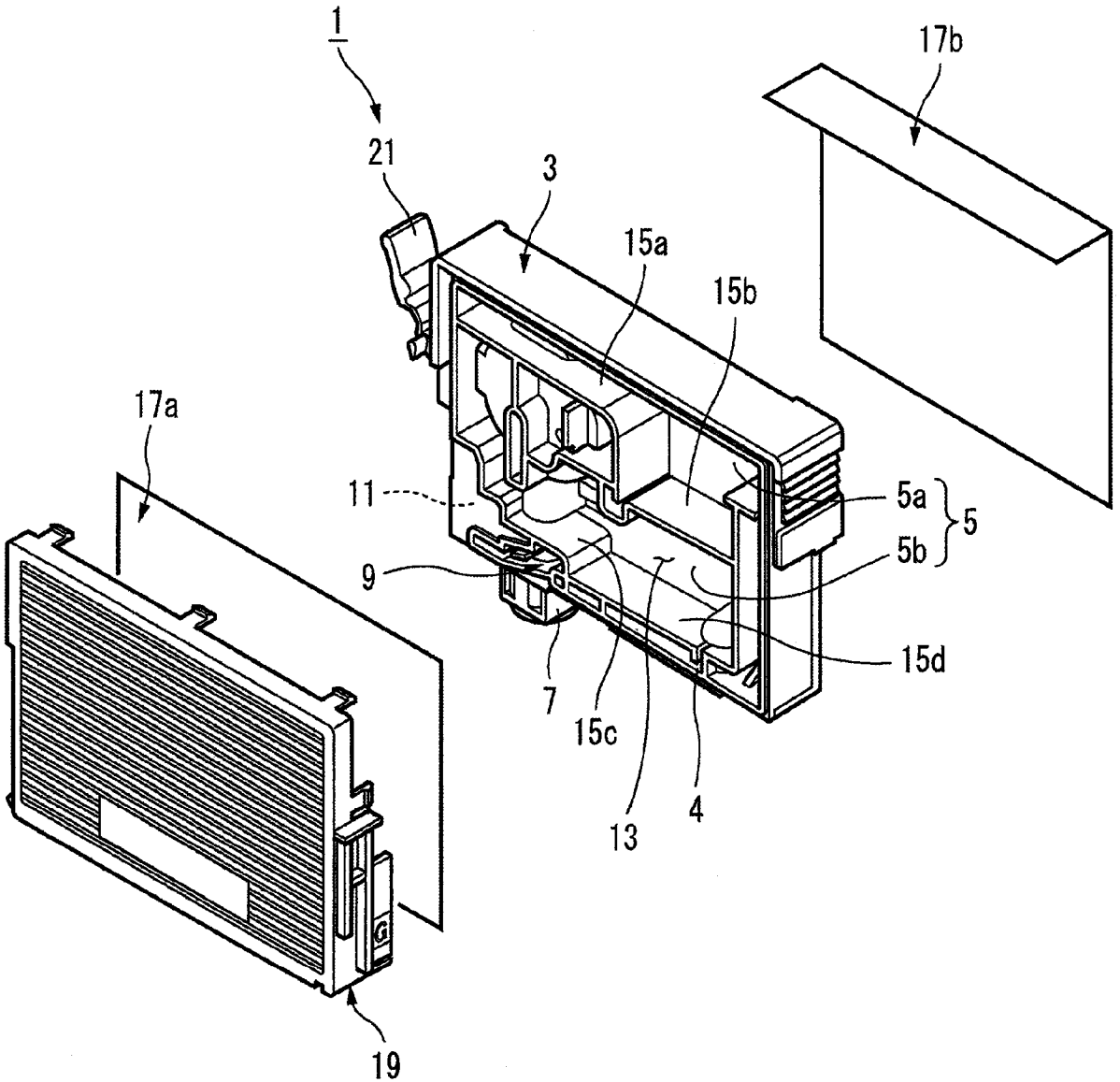
FIG. 2 is an exploded perspective view of the liquid container shown in FIG. 1.
Figure 3:
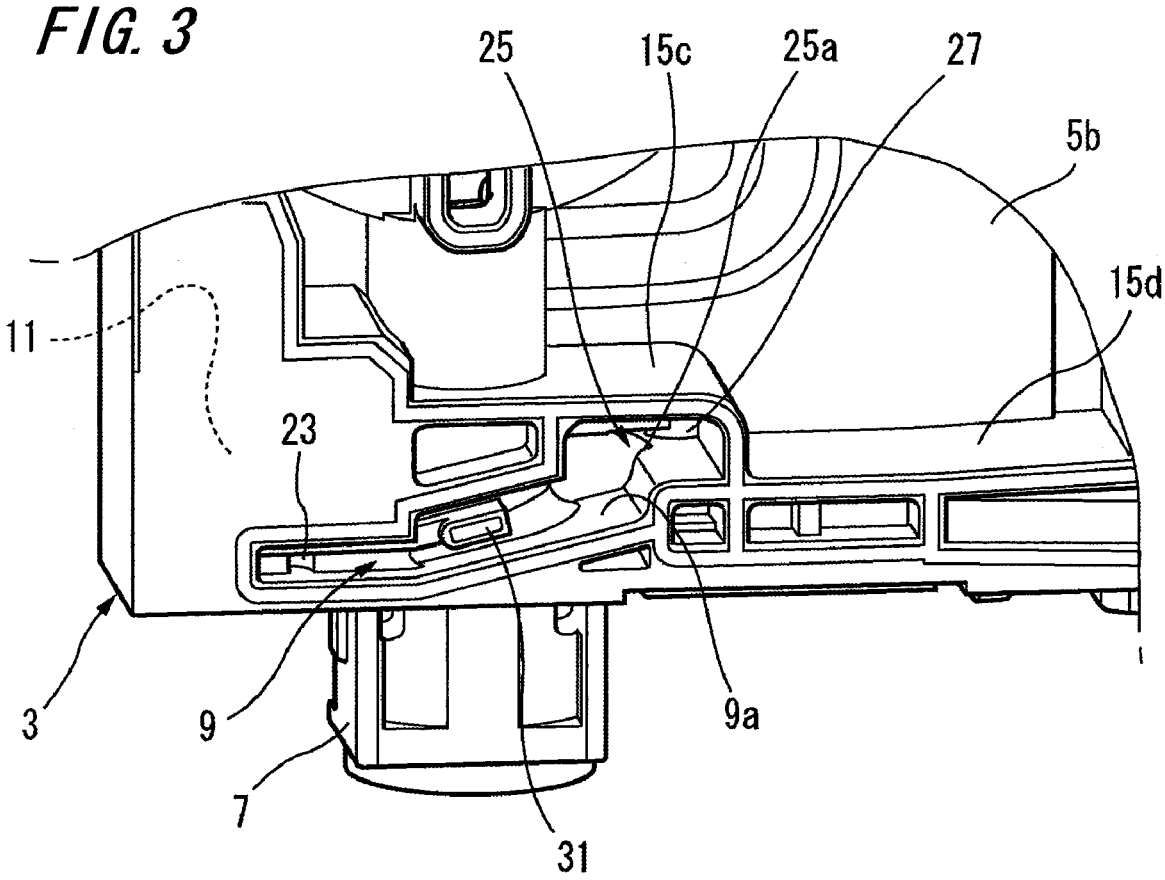
FIG. 3 is an expanded perspective view of FIG. 2.
Figure 4:
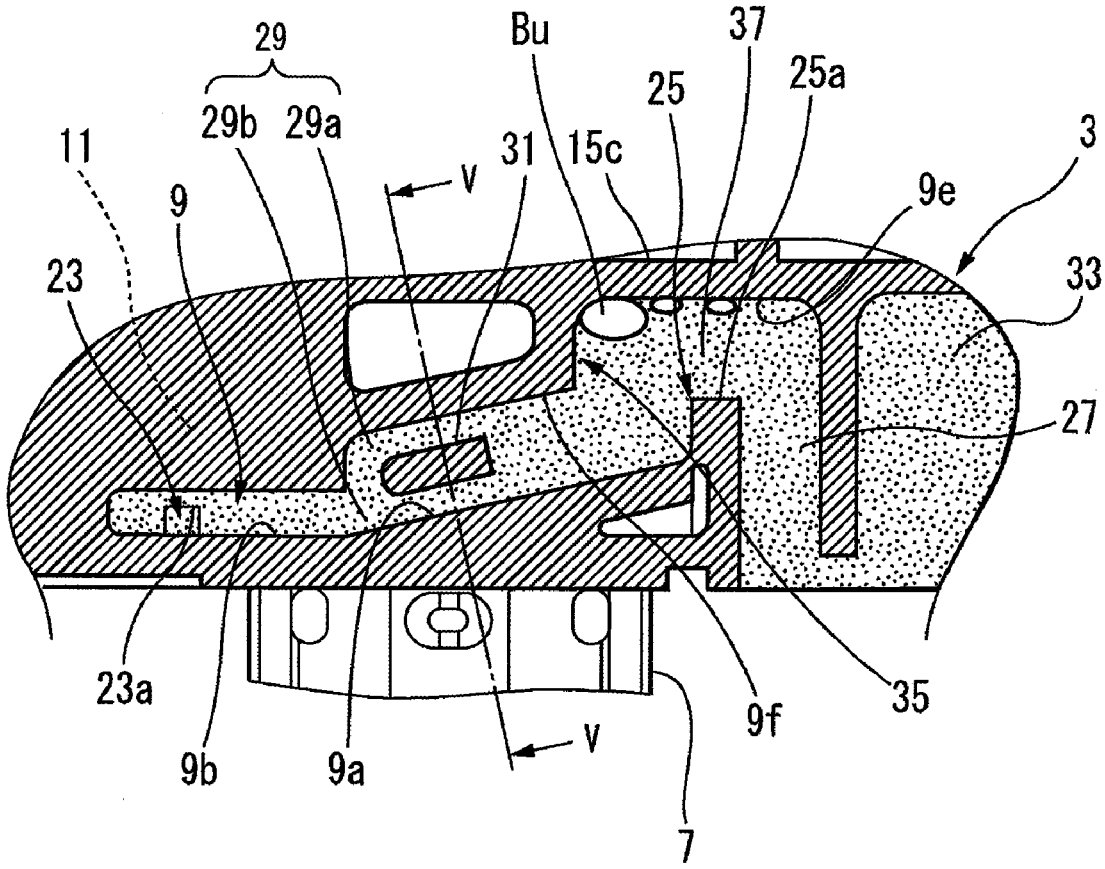
FIG. 4 is an expanded perspective view of a liquid guide path shown in FIG. 3.
Figure 5:
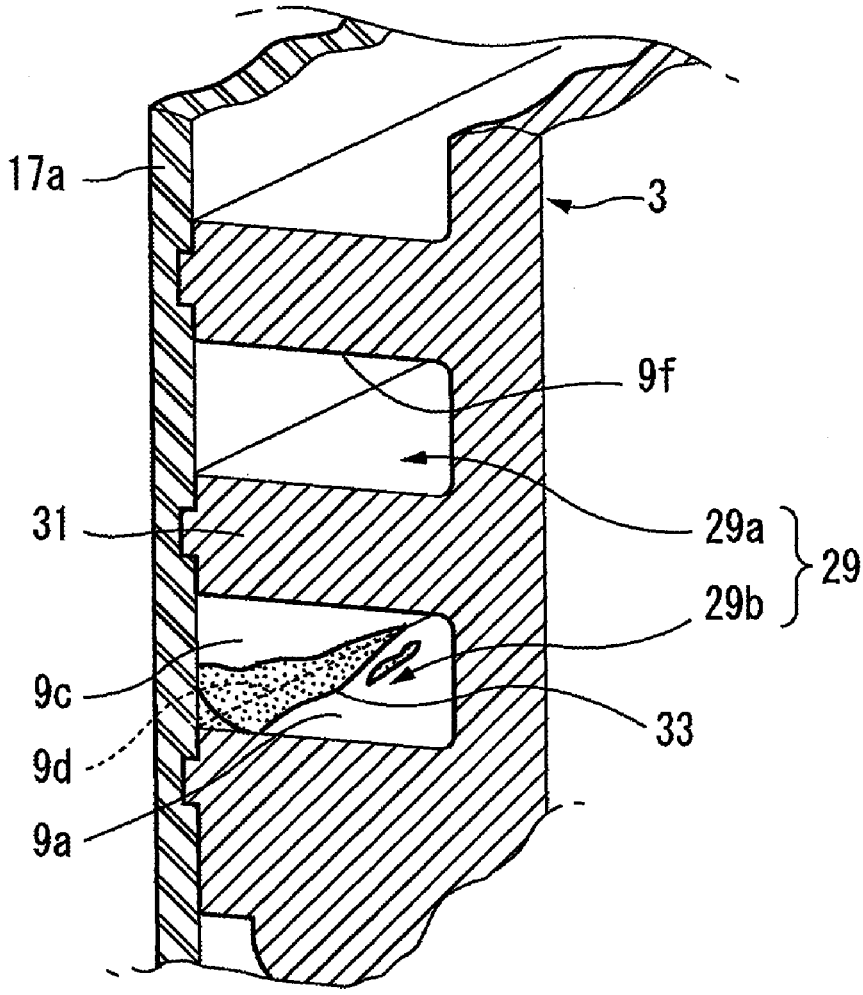
FIG. 5 is a perspective cross-sectional view taken along the line V-V of FIG. 4.
Figure 6A:
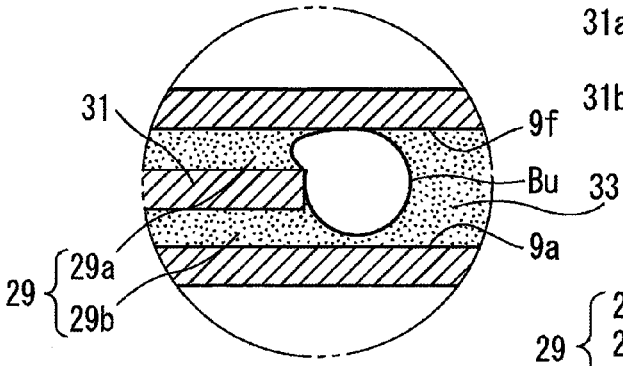
FIGS. 6A and 6B are explanatory views illustrating an asymmetric deformation, in which bubbles are eccentric to a narrow flow passage, and a symmetric deformation, respectively.
Figure 6B:
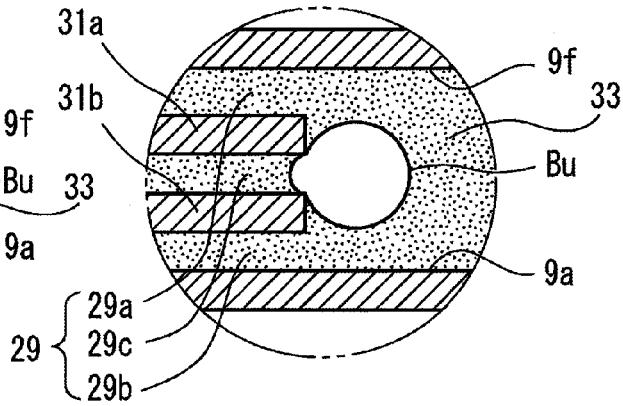

FIG. 1 is an exterior perspective view of a liquid container according to an embodiment of the invention. FIG. 2 is an exploded perspective view of the liquid container shown in FIG. 1. FIG. 3 is an expanded perspective view of FIG. 2. FIG. 4 is an expanded perspective view of a liquid guide path shown in FIG. 3. FIG. 5 is a perspective cross-sectional view taken along the line V-V of FIG. 4. FIGS. 6A and 6B are explanatory views illustrating an asymmetric deformation, in which bubbles are eccentric to a narrow flow passage, and a symmetric deformation, respectively.

As shown in FIG. 1, an ink cartridge 1 according to this embodiment is a liquid container that is detachably mounted on a cartridge mounting portion on a carriage, on which a printing head serving as a liquid ejecting unit is mounted, in an ink jet printer (not shown).

As shown in FIG. 2, the ink cartridge 1, which is an air-open type ink cartridge, includes, in a container main body 3 to be detachably mounted on a cartridge mounting portion of an ink jet printer (liquid consuming device), an ink containing portion (liquid containing portion) 5 that has an upper storage portion 5*a* and a lower storage portion 5*b* for storing ink (liquid), an ink supply portion 7 that is connected to a printing head of the printer, an ink guide path (liquid guide path) 9 that guides ink stored in the ink containing portion 5 to the ink supply portion 7, and an air communicating opening 4 that introduces air from the outside into the ink containing portion 5 according to consumption of ink in the ink containing portion 5.

In this embodiment, an ink termination sensor (liquid detecting unit) 11 is provided at a position close to the ink supply portion 7 of the ink guide path 9 and detects an inflow of air into the ink guide path 9 so as to detect that ink of the ink containing portion 5 is exhausted to a predetermined amount. The ink termination sensor 11 formed by disposing a sensor having a piezoelectric vibrating body in a sensor room formed in the ink guide path 9. If air introduced from the air communicating opening 4 into the ink containing portion 5 according to ink consumption reaches a detection position of the sensor, it is detected, from a change in vibration characteristic between when the sensor room formed in the ink guide path 9 is filled with ink and when air is in contact with the periphery of the sensor, that the ink is consumed to a predetermined amount.

In the container main body 3, partition walls 15*a*, 15*b*, 15*c*, 15*d*, . . . are formed on both sides of an intermediate wall 13. The partition walls 15*a*, 15*b*, 15*c*, 15*d*, . . . form the ink containing portion 5 and the ink guide path 9 serving as the ink guide path 9. The ink containing portion 5 and the ink guide path 9 communicate with each other through a through hole (not shown), which is formed in the intermediate wall 13, over both sides of the container main body 3.

Films 17*a* and 17*b* are adhered to both sides of the container main body 3 to be close to the partition walls 15*a*, 15*b*, 15*c*, 15*d*, . . . . The films 17*a* and 17*b* close openings of both sides of the container main body 3 so as to form the ink containing portion 5 and the ink guide path 9. A cover member 19 is fitted to a surface of the container main body 3 sealed by the film 17*a*. Referring to FIG. 2, a lever 21 that attaches/detaches the ink cartridge 1 to/from the cartridge mounting portion on the carriage is provided on the outer surface of the container main body 3.

As shown in FIGS. 3 and 4, in the ink guide path 9, a dam portion 25 is provided such that its upper end 25*a* is disposed above a circumferential upper portion 23*a* of an ink inflow opening 23 in a vertical direction. The ink inflow opening 23 causes ink 33 to flow into the sensor room, in which the ink termination sensor 11 is provided. Referring to FIG. 4, in this embodiment, an ink inlet port 27 to be described below is formed at a right end of the ink guide path 9 in FIG. 4, and the ink inflow opening 23 is formed at a left end of the ink guide path 9.

The ink 33 in the ink guide path 9 passes through the ink inlet port 27 upward and then flows into the ink inflow opening 23 at the left end beyond the dam portion 25. The ink 33 that passes through the ink guide path 9 passes through the dam portion 25, and then flows into the ink inflow opening 23 at a position lower than the upper end 25*a* of the dam portion 25.

When bubbles Bu are mixed in the ink 33 passing through the dam portion 25, buoyancy acts against the bubbles Bu upon the approach to the ink inflow opening 23 by the ink 33 filled in the ink guide path 9. Then, the bubbles Bu rarely enter the ink inflow opening 23. Further, when the ink 33 in the ink guide path 9 gradually decreases, a liquid level gradually falls from the upper end 25*a* of the dam portion 25. Therefore, when a residual liquid exists in the ink guide path 9, there is no case where the liquid level reaches the ink inflow opening 23 earlier.

At least a part of the ink guide path 9 between the ink inflow opening 23 and the dam portion 25 has a bottom surface 9*a* that is inclined vertically downward toward the ink inflow opening 23. In this embodiment, a horizontal bottom surface 9*b* is formed between the bottom surface 9*a* and the ink inflow opening 23. Alternatively, the horizontal bottom surface 9*b* may be omitted and the bottom surface 9*a* may be directly connected to the ink inflow opening 23.

With the inclined bottom surface 9*a*, when ink of the ink guide path 9 gradually decreases, and the liquid level gradually falls from the upper end 25*a* of the dam portion 25, the ink 33 distant from the ink inflow opening 23 gradually flows toward the ink inflow opening 23 along the inclined bottom surface 9*a*. That is, the discharge of the ink 33 becomes good, and entire residual ink is guided to the ink inflow opening 23 without remaining in the ink guide path 9.

A narrow flow passage 29 is formed above the bottom surface 9*a* of the ink guide path 9 so as to cause a capillary phenomenon in the ink 33. With the narrow flow passage 29, if the ink 33 enters the narrow flow passage 29 beyond the dam portion 25, the ink 33 is sucked into the ink inflow opening 23 by a liquid flow and the capillary phenomenon, and thus a good liquid flow with no delay is obtained.

When the termination of ink of the ink guide path 9 (a boundary between air and liquid) passes through the narrow flow passage 29, the ink 33 at the termination is reliably guided to the ink inflow opening 23 by a suction action according to the capillary phenomenon, without remaining at the termination.

The narrow flow passage 29 is provided with a partition wall piece 31 that is formed in the ink guide path 9 above the bottom surface 9*a*, such that two small flow passages 29*a* and 29*b* are formed. That is, the narrow flow passage 29 has a plurality of small flow passages 29*a* and 29*b* that are arranged in parallel.

With the small flow passages 29*a* and 29*b* of the narrow flow passage 29, the suction action is secured, and a large sectional area of a flow passage, through which the ink 33 passes, is secured, thereby reducing a head loss of the ink 33. Further, it is possible to reduce a possibility that a large bubble (or a boundary between air and liquid) reaches the ink inflow opening 23 compared with a case where one ink guide path 9 having the same flow passage sectional area is formed.

In this embodiment, as shown in FIGS. 5, 6A, and 6B, the small flow passages 29*a* and 29*b* of the narrow flow passage 29 are formed in a rectangular sectional shape.

As such, since a short side of the rectangular sectional shape is set sufficiently smaller than its long side, the flow passage becomes flat. Further, it is possible to enhance a bubble inflow prevention effect in the ink 33 compared with a case the ink guide path 9 having the same flow passage sectional area is formed in a circular shape. In addition, as shown in FIGS. 3 and 4, the ink inlet port 27 on the uppermost stream side of the ink guide path 9 is a round hole having a diameter larger than the short side of the rectangular sectional shape of the narrow flow passage 29. The ink 33 flowing into the ink guide path 9 passes through the ink inlet port 27 upward, and then flows into the narrow flow passage 29 beyond the dam portion 25.

As such, since the ink inlet port 27 of the ink guide path 9 is the round hole having a diameter larger than the short side of the rectangular sectional shape of the narrow flow passage 29. Accordingly, when a plurality of bubbles each having a diameter equal to or less than the short side of the rectangular sectional shape flow into the ink inlet port 27, the bubbles can be combined with each other and grown to have the same size as the round hole to the maximum, such that the bubbles Bu in the ink 33 rarely pass through the narrow flow passage 29. That is, when the ink inlet port 27 is formed to have a diameter equal to or less than the short side of the rectangular sectional shape, all the bubbles Bu passing through the ink inlet port 27 enter the narrow flow passage 29. According to the above-described configuration, however, since the bubbles Bu are grown to have a size not enough to pass through the narrow flow passage 29, the bubbles Bu in the ink 33 can be effectively prevented from entering the ink inflow opening 23.

As shown in FIG. 5, at least one of inner wall surfaces in the small flow passage 29*a* constituting the narrow flow passage 29 serve as a top surface 9*f* that is an inner wall surface of the ink guide path 9. Further, one inner wall surface in the small flow passage 29*b* constituting the narrow flow passage 29 becomes the bottom surface 9*a* that is an inner wall surface of the ink guide path 9, and is connected to the horizontal bottom surface 9*b*.

As such, one inner wall surface in each of the small flow passages 29*a* and 29*b* constituting the narrow flow passage 29 serves as the top surface 9*f* or the bottom surface 9*a* that is the inner wall surface of the ink guide path 9. Therefore, as shown in FIG. 6A, a bubble Bu in the ink 33, an outer circumference of which is brought into contact with the top surface 9*f* of the ink guide path 9 and which has a diameter not enough to enter the small flow passage 29*a*, becomes eccentric to the small flow passage 29*a*.

That is, since the bubble Bu is brought into contact with and bound by the inner wall surface, the bubble Bu is forcibly deformed asymmetrically to a symmetry axis passing through the center.

In contrast, for example, as shown in FIG. 6B, when the narrow flow passage 29 has a small flow passage 29*c* that is formed by a pair of partition wall pieces 31*a* and 31*b*, one inner wall surface of the small flow passage 29*c* does not serve as the top surface 9*f* or the bottom surface 29*a* of the ink guide path 9.

The bubble Bu in the ink 33 having a diameter not enough to enter the small flow passage 29*c* becomes concentric to the small flow passage 29*c*, and is deformed symmetrically to a symmetry axis passing through the center.

Therefore, with the action of surface tension, the asymmetric deformation shown in FIG. 6A exhibits a larger restitution force of the bubble Bu to a sphere than the symmetric deformation does. Accordingly, the bubbles Bu in the ink 33 can rarely be sucked into the small flow passage 29*a*. That is, only the ink 33 can easily enter the narrow flow passage 29.

The inner wall surface of the small flow passage 29*b* becomes the bottom surface 9*a* of the ink guide path 9 and is connected to the horizontal bottom surface 9*b*. Then, as shown in FIG. 5, a corner 9*d* that is formed between the bottom surface 9*a* and the inner wall surface 9*c* extends to the ink guide path 9 and the ink inflow opening 23. Accordingly, ink 33 in the narrow flow passage 29 can be attracted to the ink inflow opening 23 by the capillary phenomenon occurring at the corner 9*d*.

As shown in FIG. 4, in the ink guide path 9, a step portion 35 is provided such that its top surface 9*f* on a downstream side is provided vertically downward from its top surface 9*e* on an upstream side. With the step portion 35, an air pocket 37 is formed above the dam portion 25.

When the ink 33 from the ink inlet port 27 flows the liquid guide path 9 toward the ink inflow opening 23, the ink 33 is caught by the step portion 35. Accordingly, the bubble Bu that is mixed in the ink 33 is separated from ink, and the separated bubble Bu remains at the top surface 9*e* above the step portion 35 by buoyancy. Further, with this separation action, small bubbles Bu that originally pass through the narrow flow passage 29 can be grown to large bubbles Bu that do not pass through the narrow flow passage 29, and thus the bubbles Bu are rarely stuck to the ink termination sensor 11.

According to the ink cartridge 1 of this embodiment, since the dam portion 25 is provided such that the upper end 25*a* is disposed above the circumferential upper portion 23*a* of the ink inflow opening 23 in the vertical direction, the ink 33 passing through the ink guide path 9 passes through the dam portion 25 and then flows into the ink inflow opening 23 at the position lower than the upper end 25*a* of the dam portion 25.

When the bubble Bu is mixed in the ink 33 passing through the dam portion 25, buoyancy acts against the bubble Bu upon the approach to the ink inflow opening 23 by the ink 33 filled in the ink guide path, and thus the bubble Bu rarely enters the ink inflow opening 23. Accordingly, the erroneous detection due to sticking of the bubble Bu, which is mixed in ink of the ink containing portion 5, to the ink termination sensor 11 can be prevented.

When the ink 33 of the ink guide path 9 gradually decreases, the liquid level gradually falls from the upper end 25*a* of the dam portion 25. Therefore, when the residual liquid exists in the ink guide path 9, there is no case where the liquid level reaches the ink inflow opening 23 earlier. As a result, there is no case where the ink residual quantity of the ink containing portion 5 is erroneously detected as zero, unlike the actual state.

The configuration of the container main body, the liquid containing portion, the liquid supply portion, the liquid guide path, the air communicating opening, the liquid detecting unit, the dam portion, and the like of the invention are not limited to the configuration of the above-described embodiment. Various changes can be made on the basis of the spirit or scope of the invention.

Although it is preferable that the liquid container according to the invention is provided with the dam portion, by forming the narrow passage formed in a part of the liquid guide path communicating the liquid containing portion and the liquid detecting unit with each other so as to cause a capillary phenomenon in the liquid, and a step portion provided at a upstream of the narrow flow passage such that its top surface on a downstream side is provided vertically downward from an upstream side, the liquid can be caught at the step portion when the liquid flows in the liquid guide path toward the liquid inflow opening. Thus when bubbles are mixed in the liquid, the bubbles are separated from the liquid, and the separated bubbles remain at the top surface above the step portion by buoyancy. With this separation action, small bubbles that originally pass through the narrow flow passage can be grown to large bubbles that do not pass through the narrow flow passage, and thus bubbles are rarely stuck to the liquid detecting unit.

The use of the liquid container of the invention is not limited to the ink cartridge of the ink jet recording apparatus described above. The liquid container of the invention can be used in various liquid consuming devices having a liquid jetting head for jetting very small liquid droplets.

Specific examples of the liquid consuming device include a device having a color material jetting head used in manufacturing color filters of a liquid crystal display or the like, a device having an electrode material (conductive paste) jetting head used in forming electrodes of an organic electroluminescent (EL) display or a surface emission display (FED), a device having a bioorganic compound jetting head used in manufacturing a bio-chip, a device having a sample spraying head as a precision pipette, a textile printing device, or a micro dispenser.

What is claimed is:

1. A liquid container detachably mounted on a liquid consuming device, the liquid container comprising:

a liquid containing portion;

a liquid supply portion that is connected to the liquid consuming device;

a liquid guide path that guides a liquid stored in the liquid containing portion to the liquid supply portion;

an air communicating opening that introduces air from the outside into the liquid containing portion according to consumption of the liquid in the liquid containing portion; and a liquid detecting unit that is provided the liquid guide path and detects an inflow of the air into the liquid guide path so as to detect that the liquid of the liquid containing portion is exhausted to a predetermined amount, wherein, a dam portion is provided in the liquid guide path such that its upper end is disposed above, in a vertical direction, a circumferential upper portion of a liquid inflow opening causing the liquid to flow into the liquid detecting unit, and wherein at least a part of a bottom surface of the liquid guide path between the liquid inflow opening and the dam portion is inclined vertically downward toward the liquid inflow opening.

2. A liquid container detachably mounted on a liquid consuming device, the liquid container comprising:

a liquid containing portion;

a liquid supply portion that is connected to the liquid consuming device;

a liquid guide path that guides a liquid stored in the liquid containing portion to the liquid supply portion;

an air communicating opening that introduces air from the outside into the liquid containing portion according to consumption of the liquid in the liquid containing portion; and a liquid detecting unit that is provided the liquid guide path and detects an inflow of the air into the liquid guide path so as to detect that the liquid of the liquid containing portion is exhausted to a predetermined amount, wherein, a dam portion is provided in the liquid guide path such that its upper end is disposed above, in a vertical direction, a circumferential upper portion of a liquid inflow opening causing the liquid to flow into the liquid detecting unit, and wherein a narrow flow passage is formed in the liquid guide path so as to cause a capillary phenomenon in the liquid.

3. The liquid container according to claim 2, wherein a plurality of the narrow flow passages are formed in parallel.

4. The liquid container according to claim 2, wherein the narrow flow passage is formed in a rectangular sectional shape.

5. The liquid container according to claim 4, wherein an inlet port on an uppermost stream side of the liquid guide path is a round hole having a diameter larger than a short side of the rectangular sectional shape of the narrow flow passage.

6. The liquid container according to claim 2, wherein at least one of inner wall surfaces in the narrow flow passage serves as an inner wall surface of the liquid guide path.

7. A liquid container detachably mounted on a liquid consuming device, the liquid container comprising:

a liquid containing portion;

a liquid supply portion that is connected to the liquid consuming device;

a liquid guide path that guides a liquid stored in the liquid containing portion to the liquid supply portion;

an air communicating opening that introduces air from the outside into the liquid containing portion according to consumption of the liquid in the liquid containing portion; and a liquid detecting unit that is provided the liquid guide path and detects an inflow of the air into the liquid guide path so as to detect that the liquid of the liquid containing portion is exhausted to a predetermined amount, wherein, a dam portion is provided in the liquid guide path such that its upper end is disposed above, in a vertical direction, a circumferential upper portion of a liquid inflow opening causing the liquid to flow into the liquid detecting unit, and wherein a step portion is provided in the liquid guide path such that its top surface on a downstream side is provided vertically downward from an upstream side.

8. A liquid container detachably mounted on a liquid consuming device, the liquid container comprising:

a liquid containing portion;

a liquid supply portion that is connected to the liquid consuming device;

a liquid guide path that guides a liquid stored in the liquid containing portion to the liquid supply portion;

an air communicating opening that introduces air from the outside into the liquid containing portion according to consumption of the liquid in the liquid containing portion; and a liquid detecting unit that is provided in the liquid guide path and detects an inflow of air into the liquid guide path so as to detect that the liquid of the liquid containing portion is exhausted to a predetermined amount, wherein a narrow flow passage is formed in a part of the liquid guide path communicating the liquid containing portion and the liquid detecting unit with each other so as to cause a capillary phenomenon in the liquid, and wherein a step portion is provided at a upstream of the narrow flow passage such that its top surface on a downstream side is provided vertically downward from an upstream side.

9. The liquid container according to claim 8, wherein a plurality of the narrow flow passages are formed in parallel.

10. The liquid container according to claim 8, wherein the narrow flow passage is formed in a rectangular sectional shape.

11. The liquid container according to claim 10, wherein an inlet port on an uppermost stream side of the liquid guide path is a round hole having a diameter larger than a short side of the rectangular sectional shape of the narrow flow passage.

12. The liquid container according to claim 8, wherein at least one of inner wall surfaces in the narrow flow passage serves as an inner wall surface of the liquid guide path.

* * * * *